United States Patent [19]

Steele

[11] Patent Number: 4,643,334

[45] Date of Patent: Feb. 17, 1987

[54] GRAVITY FED DISPENSER FOR SOFT DRINK CUP LIDS AND THE LIKE

[76] Inventor: Francis J. Steele, 10711 South 85th East Ave., Tulsa, Okla. 74133

[21] Appl. No.: 689,376

[22] Filed: Jan. 7, 1985

[51] Int. Cl.[4] ..... B65H 1/06

[52] U.S. Cl. ..... 221/63; 221/34; 221/61; 221/303; 221/311; 206/44.12

[58] Field of Search ..... 221/84, 45, 61, 63, 221/303, 33, 311, 312 R, 312 A, 312 C, 55, 62; 312/42, 43; 206/39, 44.12, 449, 494

[56] References Cited

U.S. PATENT DOCUMENTS

| | | | |
|---|---|---|---|
| 1,256,913 | 2/1918 | Luellen | 221/63 |
| 1,576,010 | 3/1926 | Swartz | 221/311 |
| 2,456,068 | 12/1948 | Liben | 221/61 X |
| 3,156,378 | 11/1964 | Bua . | |
| 3,164,298 | 1/1965 | Repko . | |
| 3,664,546 | 5/1972 | Shelley . | |
| 3,767,082 | 10/1973 | House . | |
| 4,382,526 | 5/1983 | Stone | 221/34 |

FOREIGN PATENT DOCUMENTS

| | | | |
|---|---|---|---|
| 345346 | 3/1931 | United Kingdom | 312/42 |

*Primary Examiner*—H. Grant Skaggs
*Assistant Examiner*—Edward S. Ammeen
*Attorney, Agent, or Firm*—Schmidt, Johnson, Hovey & Williams

[57] ABSTRACT

A dispenser for storing and sequentially dispensing flexible synthetic resin disposable lids or other similar flexible, generally flat articles has an elongated, upright container with an abutment shelf extending partially across its lower end. A dispensing aperture coplanar with the shelf is disposed between the latter and a front wall of the container. The weight of the stacked lids automatically forces the exposed portion of the flexible, lowermost lid through the dispensing aperture toward a hand engageable position. As the lowermost lid is pulled through the opening, a front wall portion of the container engages the next adjacent lid to retain the same within the container. In preferred forms, an inclined lip segment extends downwardly from the abutment shelf below the aperture to limit the flexure of the lids as the latter are singularly dispensed in response to user demand.

5 Claims, 12 Drawing Figures

Fig. 7
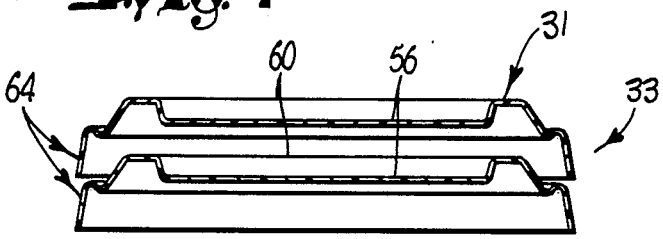
Fig. 8
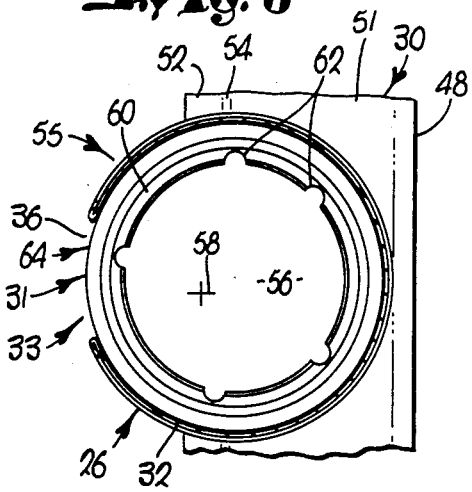
Fig. 9
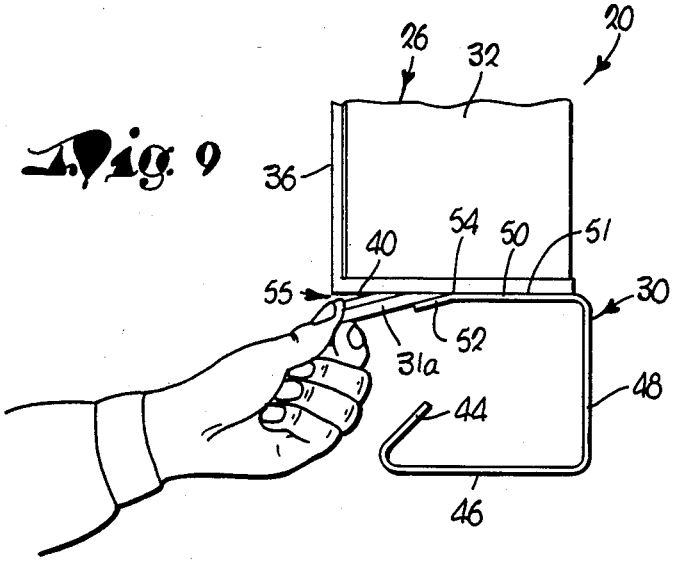
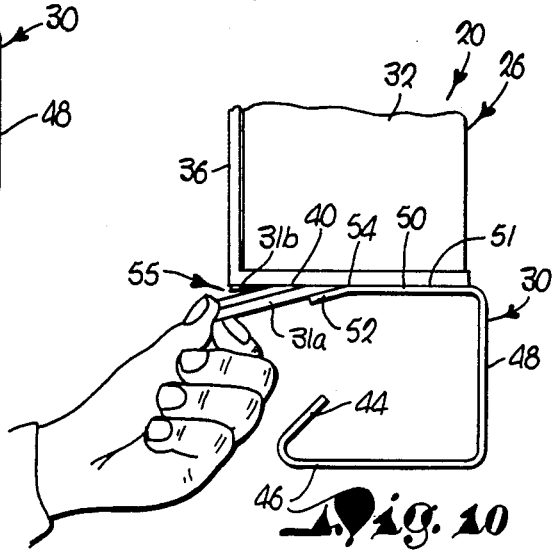
Fig. 10
Fig. 11
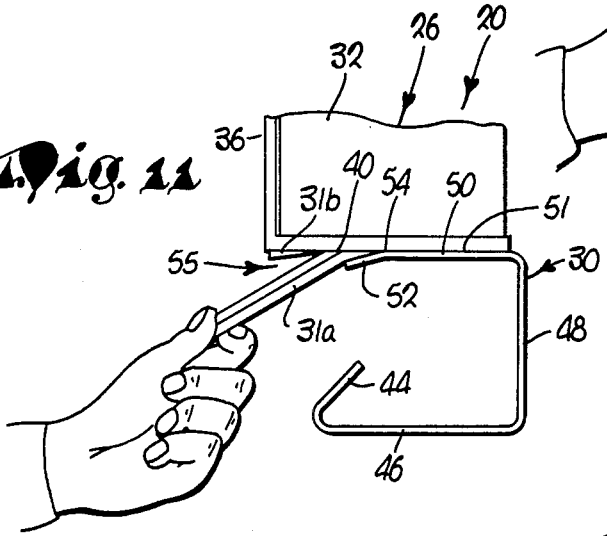
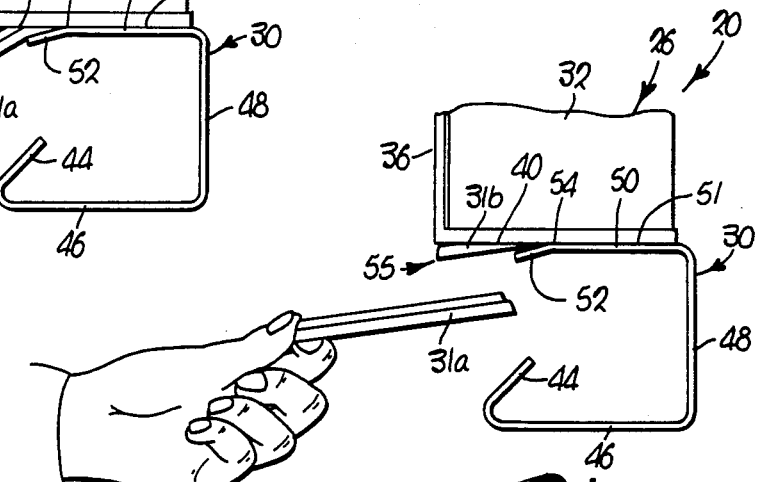
Fig. 12

GRAVITY FED DISPENSER FOR SOFT DRINK CUP LIDS AND THE LIKE

BACKGROUND OF THE INVENTION

1. Field of the Invention

This invention relates to a cup lid dispenser for efficiently storing the lids and serially dispensing the same in response to user demand. More particularly, it is concerned with a lid dispenser comprising an elongated cylindrical container having a lower abutment shelf, with an aperture adjacent the shelf particularly constructed for serially dispensing the lids.

2. Description of the Prior Art

Many types of dispensers are in use today, each generally constructed to serially dispense a particular article. In today's highly competitive retail markets, such dispensers are of major importance for conveniently and quickly discharging articles into the hands of the store personnel or ultimate consumer. Dispensers for paper cups, for example, are notably popular in stores or restaurants, often dispensing the cups directly to the ultimate consumer.

However, few means are available for dispensing disposable cup lids used in conjunction with the above referenced disposable cups. Most often, sales personnel place an elongated stack of interfitted lids in a horizontal, open tray such that the longitudinal axis of the stack is disposed horizontally within the tray.

As can be appreciated, such open-storage trays for disposable lids must generally be kept away from the public's reach because of the danger of bacterial transmission or other soilage of the lids within the stack by food spillage and the like. Such contamination can easily render a large number of lids instantly unsuitable for use or sale. As a result, the trays are normally accessible only by store personnel, consequently creating a situation where the clerk is constantly interrupted by a consumer for assistance. Obviously, such a dispensing device entirely defeats the principles underlying the convenient, economical "self-service" marketing methods.

SUMMARY OF THE INVENTION

The problems outlined above are in large measure solved by the lid dispenser in accordance with the present invention. The dispenser as set forth herein serially dispenses the lids in accordance with user demand and can be operated by the ultimate consumer without danger of contamination or other damage to the remaining lids.

In particular, the present invention includes an elongated, normally upright cylindrical container having an upper and lower end, and an abutment shelf at the lower end supporting a plurality of stacked lids within the container. A dispensing aperture is disposed adjacent the shelf, exposing a portion of the lowermost lid in the stack such that the exposed portion flexes downwardly through the opening toward a hand engageable position. As the lid is pulled through the aperture, a sidewall of the container engages the next adjacent lid of the stack and retains the latter within the container.

In particularly preferred forms, the abutment shelf extends diametrically across the lower end of the cannister and a flat lip segment connecting the shelf is inclined downwardly adjacent the aperture. The shelf limits the flexure of the lid as the latter is individually pulled through the aperture, reducing the possibility of damage to the lid and accidental discharge of the next adjacent lid. Additionally, the container preferably has a longitudinal opening for inspection of the stacked lids and for finger access when necessary. Thus, the dispenser of the instant invention provides both a storing and dispensing means for plastic lids yet is easily and rapidly operable by the ultimate consumer, thereby increasing efficiency of the retail personnel.

BRIEF DESCRIPTION OF THE DRAWINGS

FIG. 7 is an enlarged sectional side view of two lids shown stacked in nested relationship;

FIG. 8 is an enlarged, fragmentary, top plan view of one of the loaded cannisters of the dispenser; and FIGS. 9–12 are fragmentary, enlarged views of a cannister, illustrating the successive steps of dispensing a lid.

DETAILED DESCRIPTION

Figure 1:
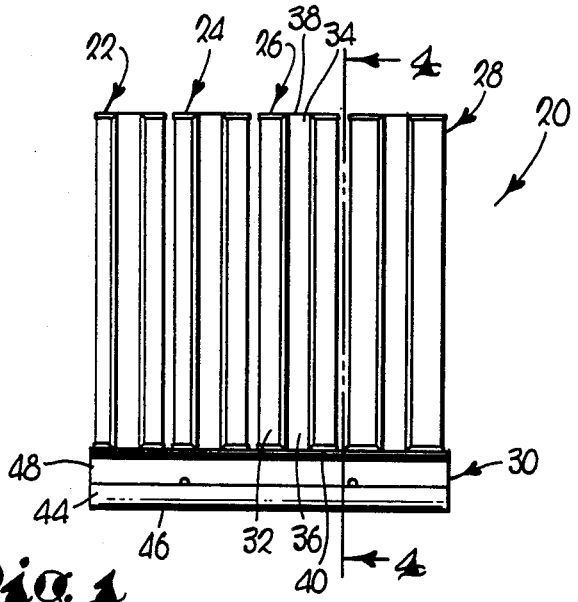
FIG. 1 is a front elevational view of the gravity fed lid dispenser in accordance with the present invention.
Figure 2:
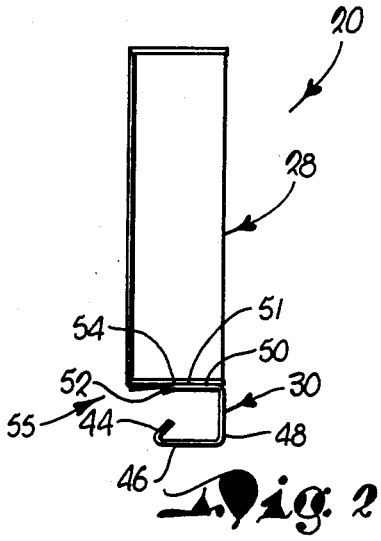
FIG. 2 is a side elevational view of the same.
Figure 3:
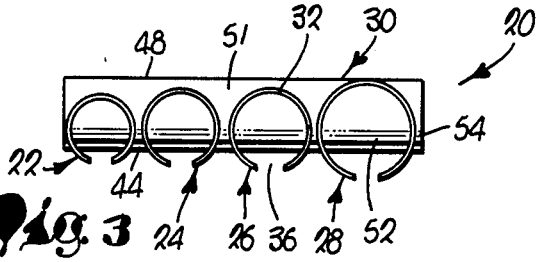
FIG. 3 is a top plan view of the same.
Figure 4:
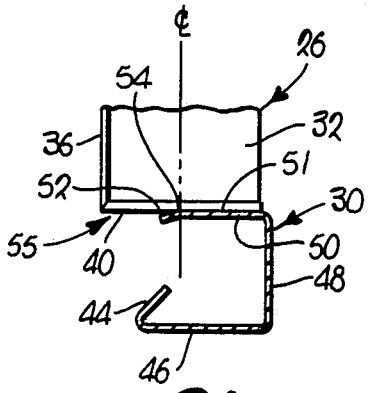
FIG. 4 is a fragmentary, enlarged, cross-sectional view taken along line 4—4 of FIG. 1.

Referring now to the drawings, a gravity fed plastic lid dispenser 20 in accordance with the instant invention broadly includes four elongated, upright cannisters 22, 24, 26 and 28 of progressively increasing diameter, each fixedly engaging, supported upon and projecting upwardly from an elongated, horizontal support stand 30. The actual number of such cannisters is discretionary, depending upon the number of different sized lids to be dispensed. Each of the cannisters 22, 24, 26 and 28 provides a storage area for a nested stack 33 of a plurality of flexible, synthetic resin lids 31 having a certain diameter.

In the discussion that follows, the cannister 26 will be described in detail, it being understood that the cannisters 22, 24 and 28 are substantially similar to the cannister 26, differing only in diameter. The cannister 26 has an elongated, transversely curved, vertical sidewall 32 having a generally transverse C-shaped cross-section defining a lid-receiving passageway 34 and a vertical, longitudinal, front inspection opening 36. The sidewall 32 has an upper, open end 38 and terminates in a lower end 40.

The stand 30 is generally transversely C-shaped and includes an upturned and inclined front wall 44, a horizontal bottom leg 46, a vertical rear bight 48 and a flat horizontal shelf leg 50, the latter having a flat, horizontal top surface 51. A flat, forwardmost lip segment 52 is integrally connected to the shelf 50 and extends downwardly and forwardly therefrom in a slight angular relation to the latter, forming an edge 54 that extends the full length of the support 30, essentially directly below the center of the cannisters 22–28.

A dispensing aperture 55 is defined at the bottom of passageway 34 between the front of sidewall 32 and the front extremity of lip 52, having a substantially semi-circular configuration.

Figure 6:
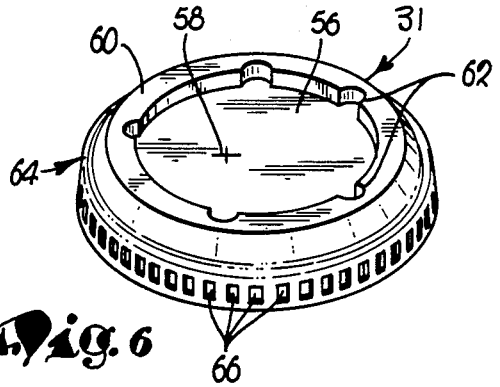
FIG. 6 is an enlarged perspective view of a typical lid to be dispensed in accordance with the principles of the present invention.

The disposable lids 31 are comprised of a synthetic resin material such as high impact polystyrene and have a generally flat configuration, although they are also slightly concavo-convex so as to nest properly when stacked. Lids 31 have sufficient inherent rigidity as to be self-sustaining with respect to shape; yet, they also may be flexed readily to a limited extent without losing their inherent memory or "set", and thus may be considered somewhat resilient when subjected to light bending loads. As illustrated in FIGS. 6–7, each of the lids 31 has a flat top portion 56 with an X-shaped, straw-receiving slit 58 thereon. A generally circular, raised boss portion 60 having a plurality of semi-circular channels 62 extends circumferentially of the top portion 56. An inclined, slightly outwardly flaring, continuous peripheral sidewall 64 having a plurality of cubical indentions 66 depends from the boss portion 60.

OPERATION

In use, a plurality of flexible lids 31 or other similar flexible, generally flat articles are inserted through the upper, open end 38 into the cannister 26 in nested, stacked relationship. The shelf 50 functions as a lower abutment means, the top surface 51 of the shelf 50 engaging a portion of the lowermost lid 31*a* in the stack 33 and supporting the latter.

Figure 5:
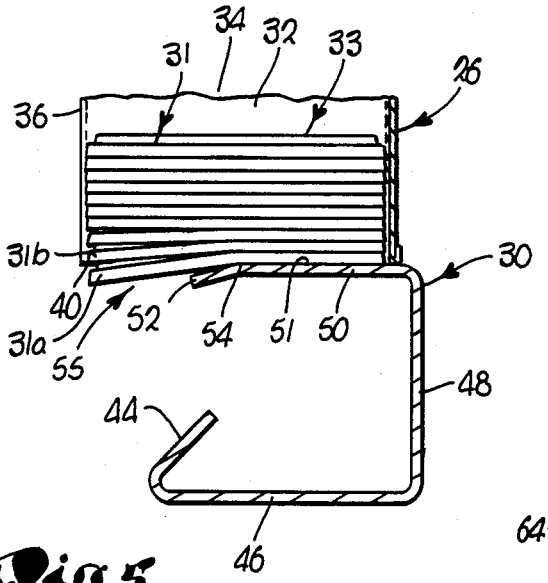
FIG. 5 is an enlarged, fragmentary, cross-sectional view of the cannister shown in FIG. 4, illustrating the stack of lids within the cannister.

Simultaneously, the aperture 55 exposes the front portion of the lowermost lid 31*a* and, because of the lack of underlying support in that area, allows the exposed portion to flex downwardly through the aperture 55 and below the front edge of sidewall 32 under the weight of the rest of the stack 33 toward a hand engageable position, as seen in FIG. 5.

As illustrated in FIG. 9, the exposed portion of the lowermost lid 31*a* may then be grasped and further flexed downwardly until the inclined lid segment 52 is engaged. By then pulling lid 31*a* outwardly in a direction generally parallel to the lip 52 (as shown in FIGS. 10 and 11), lid 31*a* may be progressively withdrawn from stack 33 until it completely clears the latter as shown in FIG. 12.

It will be appreciated that as lid 31*a* is withdrawn, the next adjacent lid 31*b* in the stack 33 tends to be urged forwardly toward the front of sidewall 32 because of the sliding resistance presented by the lowermost lid 31*a*. However, the front of sidewall 32 functions as retainer means at such time to retain lid 31*b* within the sidewall and prevent the dispensing of "doubles". Noteworthy also in this respect is the fact that because the shelf 50 and the lip 52 are constructed and arranged to limit flexure of the lowermost lid 31*a* to the extent illustrated, the next lid 31*b* is prevented from flexing below the front of sidewall 32 until lowermost lid 31*a* has been completely withdrawn.

Thus, as may be appreciated, lids may be quickly and easily dispensed individually from any selected one of the cannisters 22–28 by a simple movement of one hand while simultaneously protecting the cleanliness of all remaining lids in the stacks 33. As a result, the dispenser 20 is ideally suited for use both in clerk-assisted and "self-service" types of retail businesses.

If desired, the upright dispenser 20 may be conveniently mounted on a wall surface, thus freeing valuable counter space necessary for prior art tray dispensers. If it is instead placed on a supporting surface such as a counter top, the stand 30 spaces aperture 55 far enough above the counter top to permit unobstructed, manual access to the lowermost lid.

Furthermore, the dispenser 20 also provides a convenient storage means for a large quantity of lids 31, the longitudinal inspection opening 36 permitting the store personnel to rapidly visually identify the quantity of remaining stock. Additionally, the inspection opening 36 is operable also as a finger access opening to facilitate loading and to assist the customer in flexing the lowermost lid 31*a* downwardly in the event that the exposed portion of the latter is not flexed automatically to the hand engageable position by the weight of the overhead lids. As can be appreciated, the dispensing device of the present invention, while of simple construction, is effective to serially dispense lids or other flexible articles by means heretofore unknown in the art.

I claim:

1. A gravity-fed dispenser for use in the successive, manual dispensing of a plurality of generally flat, self-sustaining, yet flexible articles such as soft drink cup lids or the like from a stack thereof, said dispenser comprising:

upright container means provided with an internal, stack-receiving area;

an upwardly facing abutment surface at the lower end of said container means for supporting the stack of articles against escape from said area, said container means having a front and a rear with respect to the direction of transverse dispensing movement of articles from the stack;

a rearwardly facing retaining surface at the lower end of the container means adjacent the front thereof, said abutment surface having a front terminal edge spaced rearwardly from said retaining surface and disposed at the approximate fore-and-aft midpoint of the stack-receiving area, and said retaining surface having a portion thereof disposed at substantially the same height as said edge;

a dispensing aperture at the lower end of the container means defined between said portion of the retaining surface and said edge of the abutment surface and through which each successively lowermost article in the stack may be flexed downwardly about said edge and withdrawn transversely forwardly from the stack while the next article thereabove is retained by said retaining surface; and a short, inclined lip on said abutment surface projecting downwardly and forwardly from said edge in disposition for limiting the extent of downward flexure of each successively lowermost article in the stack during dispensing withdrawal thereof, said lip terminating slightly below and substantially behind said portion of the retaining surface.

2. A dispenser as claimed in claim 1, said container means being provided with a stand for supporting the container means in a raised condition on an underlying support surface whereby to dispose said aperture spaced above said support surface in a manner to provide manual access clearance to the articles during dispensing thereof.

3. A dispenser as claimed in claim 2, said stand comprising a generally transversely C-shaped, unitary member having a flat upper leg comprising said abutment surface, a flat lower leg spaced below said upper leg for contacting engagement with the support surface, and a flat, rear, normally upright bight integrally interconnecting said legs.

4. In combination with a stack of generally flat, self-sustaining, yet flexible articles such as soft drink cup lids or the like, a gravity fed dispenser for said articles comprising:

upright container means provided with an internal, stack-receiving area;

an upwardly facing abutment surface at the lower end of said container means for supporting the stack of articles against escape from said area, said container means having a front and a rear with respect to the direction of transverse dispensing movement of articles from the stack;

a rearwardly facing retaining surface at the lower end of the container means adjacent the front thereof abuttingly engaging the next-to-the lowermost article in the stack to confine the same against transverse forward movement, said abutment surface having a front terminal edge spaced rearwardly from said retaining surface and disposed at the approximate fore-and-aft midpoint of the stack-receiving area, and said retaining surface having a portion thereof disposed at substantially the same height as said edge;

a dispensing aperture at the lower end of the container means defined between said portion of the retaining surface and said edge of the abutment surface; and a short, inclined lip projecting downwardly and forwardly from said edge in disposition for limiting downward flexure of the lowermost article during withdrawal thereof from the stack, said lip terminating slightly below and substantially behind said portion of the retaining surface to facilitate access to the lowermost article in the stack when the latter has flexed downwardly about said edge under the weight of the other articles in the stack and into said aperture for manual, transversely forward withdrawal of the lowermost article from the stack.

5. In the combination as claimed in claim 4, said container means being provided with a stand for supporting the container means in a raised condition on an underlying support surface whereby to dispose said aperture spaced above said support surface in a manner to provide manual access clearance to the articles during dispensing thereof.

* * * * *